US005667021A

United States Patent [19]

Bailey et al.

[11] Patent Number: 5,667,021

[45] Date of Patent: Sep. 16, 1997

[54] APPARATUS FOR DRIVING GRADE STAKES

[75] Inventors: Vance Allen Bailey; Monte Reeves Highsmith; Ray Allen Highsmith, all of Selma; Stephen Joseph Bailey, Austin, all of Tex.

[73] Assignee: L. Castaneda Construction, Inc.

[21] Appl. No.: 542,441

[22] Filed: Oct. 12, 1995

[51] Int. Cl.[6] ..... B25D 17/00

[52] U.S. Cl. ..... 173/21; 173/31; 173/112; 173/147

[58] Field of Search ..... 173/30, 31, 34, 173/124, 112, 117, 217, 162.1, 147, 21; 29/81.11, 81.13–81.17, 81.01

[56] References Cited

U.S. PATENT DOCUMENTS

| | | | |
|---|---|---|---|
| 258,954 | 6/1882 | Tarbell et al. | 173/112 |
| 506,854 | 10/1893 | La Blanc | 173/112 |
| 647,274 | 4/1900 | Moran et al. | 173/112 |
| 2,929,459 | 3/1960 | Spitzmesser | 173/30 |
| 3,189,104 | 6/1965 | Jamer et al. | 173/31 |
| 3,437,156 | 4/1969 | Laverty | 173/21 |
| 3,543,868 | 12/1970 | Drake | 173/21 |
| 3,735,819 | 5/1973 | Ramsey | 173/21 |
| 4,050,526 | 9/1977 | Deike | 173/147 |
| 4,402,369 | 9/1983 | Nikitin et al. | 173/31 |
| 5,375,664 | 12/1994 | McDowell et al. | 173/147 |

*Primary Examiner*—Scott A. Smith

*Attorney, Agent, or Firm*—Donald R. Comuzzi; Christopher L. Makay

[57] ABSTRACT

A grade stake driver includes a frame for supporting a hammer and a grade stake under the hammer. A shuttle secured to the hammer movably mounts onto the frame to connect the hammer to the frame. A hoist secured to the shuttle mounts onto the frame to permit the raising and lowering of the hammer. A receiver mounted on the frame outputs a control signal in response to a transmitted signal. A switch mounted on the frame transforms the control signal into an on/off signal. A relay mounted on the frame connects the hammer to a power source in response to the on/off signal, thereby effecting the driving of the grade stake.

13 Claims, 3 Drawing Sheets

APPARATUS FOR DRIVING GRADE STAKES

BACKGROUND OF THE INVENTION

1. Field of the Invention

The present invention relates to the setting of grade stakes and, more particularly, but not in the way of limitation, to an apparatus for driving grade stakes.

2. Description of the Related Art

Most construction projects require the excavation and/or the use of field material to produce a grade having a desired specific elevation. Currently, the marking of specified elevations (i.e., "setting grades") requires a crew of three. One crew member operates a leveled telescopic lens or construction level, while the two other crew members carry grade stakes to predetermined locations and then drive the grade stakes into the ground under the direction of the construction level operator. The construction level operator typically communicates with the other crew members using a two-way radio or hand signals.

The marking of an elevation at a predetermined location on a construction site requires a grade stake be driven into the ground until the top surface of the stake resides at the desired elevation. The construction level operator determines the desired elevation by measuring the vertical distance between a fixed level plane (i.e., a point of known elevation) and the predetermined location. The construction level operator establishes the fixed level plane by viewing through the construction level a ruled rod having a previously leveled line of site. After establishing the fixed level plane, the measurement of the vertical distance requires the holding of the ruled rod over the predetermined location followed by the reading of the distance the predetermined location lies either above or below the known elevation. A comparison of the vertical distance to the elevation of the fixed level plane permits the determination of the elevation of the predetermined location so that the top of the grade stake may be positioned to indicate the desired elevation.

Although the above-described method of marking specified desired elevations functions satisfactorily, it is unfortunately both time consuming and labor intensive. That is especially true when the grades are set over expansive areas. For example, construction of highways stretching many miles may require four grade stakes across the road bed for every fifty feet of highway, and, because modern roads are built on several layers of compacted base material, new grades must be set at each fifty foot station for each layer. Essentially, the use of a construction level operator and several laborers wastes both time and money because the construction level operator must read the height for each grade stake, determine how far to drive each grade stake into the ground, and then instruct the laborers in the driving of the grade stake. Miscommunications often occur, and, when grade stakes are set improperly, the entire process must be repeated.

Accordingly, an apparatus that eliminates the necessity of additional laborers while ensuring the accurate setting of grade stakes will save both time and money on any construction project.

SUMMARY OF THE INVENTION

In accordance with the present invention, a grade stake driver includes a frame for supporting a hammer and a grade stake under the hammer. A harness secured to the hammer movably mounts onto the frame to connect the hammer to the frame. A hoist secured to the shuttle mounts onto the frame to permit the raising and lowering of the hammer. A receiver mounted on the frame outputs a control signal in response to a transmitted signal. A switch mounted on the frame transforms the control signal into an on/off signal. A relay mounted on the frame connects the hammer to a power source in response to the on/off signal, thereby effecting the driving of the grade stake.

The hoist includes a crank mounted on the frame and a strap connected between the shuttle and the crank to permit the raising and lowering of the hammer utilizing the crank. A spool about the crank facilitates the connection of the strap to the crank. Additionally, the hammer includes an elevation rod holder secured thereto.

The frame includes a front brace and a rear brace connected together with a transverse brace. A platform mounts to the rear brace to support power sources for the hammer and the receiver, switch, and relay. A grade stake guide mounts to the platform to support the grade stake under the hammer. The frame includes wheels to facilitate easy transportation of the grade stake driver.

It is therefore an object of the present invention to provide a grade stake driver that allows remote driving of grade stakes.

Still other objects, features, and advantages of the present invention will become evident to one of ordinary skill in the art in light of the following.

DETAILED DESCRIPTION OF THE PREFERRED EMBODIMENT

Figure 1:
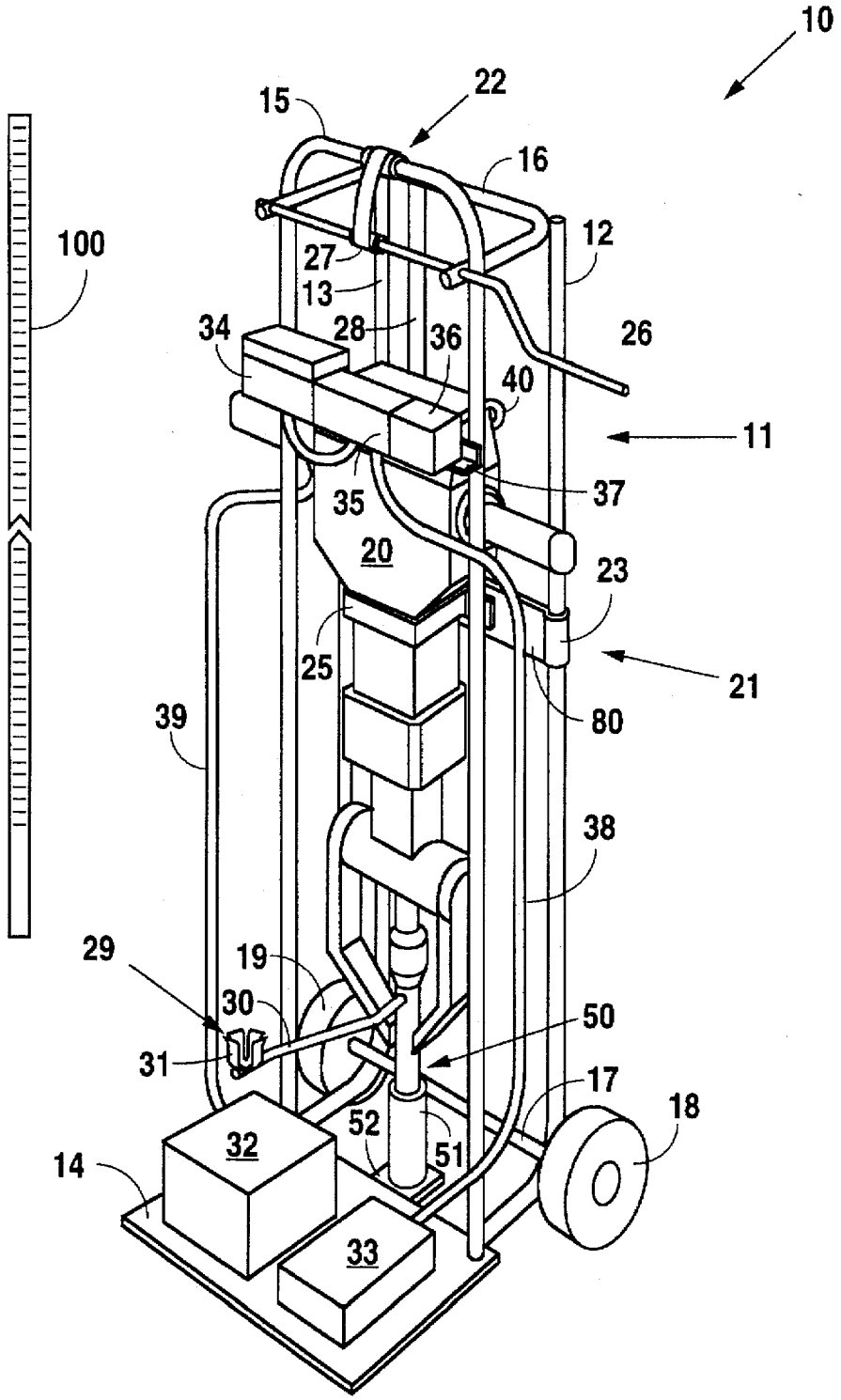
FIG. 1 is a perspective view illustrating the apparatus for driving grade stakes.
Figure 2:
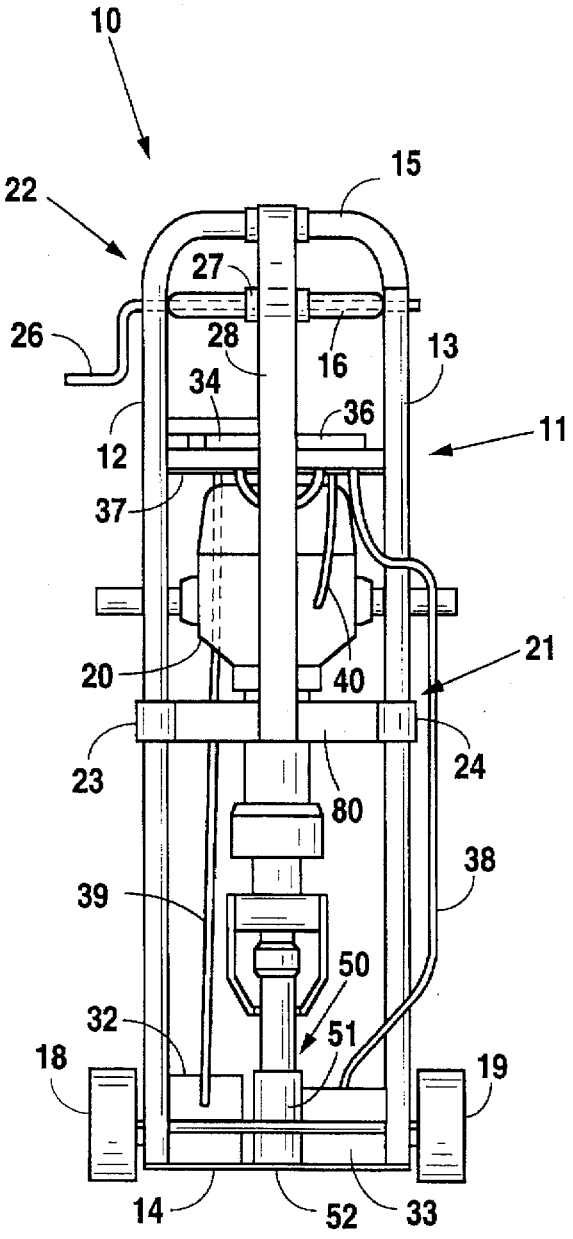
FIG. 2 is a rear plan view illustrating apparatus for driving grade stakes.
Figure 3:
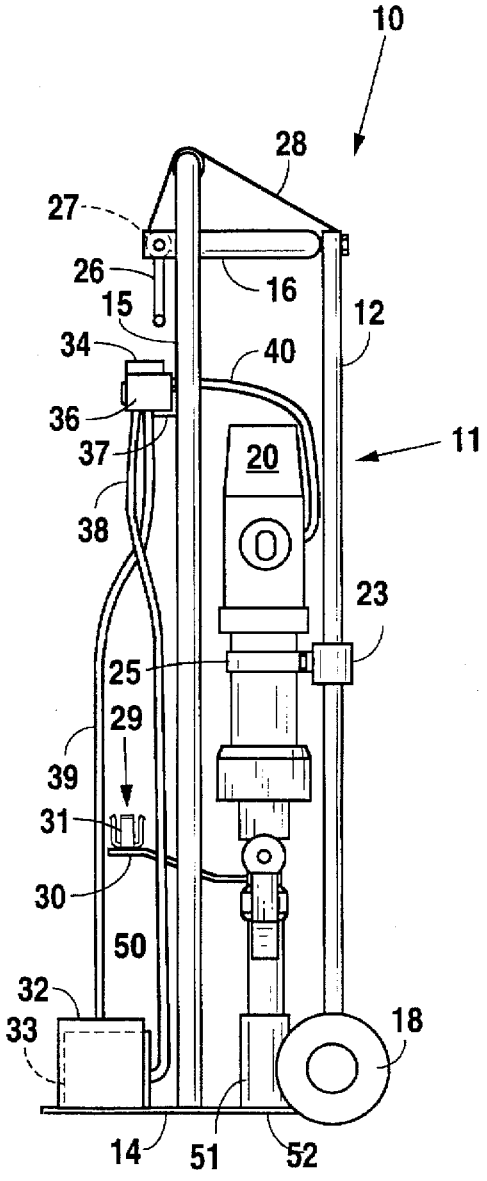
FIG. 3 is a left side plan view illustrating the apparatus for driving stakes.

As illustrated in FIGS. 1–3, grade stake driver 10 includes frame 11. Frame 11 includes rear braces 12 and 13 which are L shaped to support platform 14 at the bottom of grade stake driver 10. Platform 14 connects to rear braces 12 and 13 using any suitable means such as welding. Grade stake guide 50 attaches to platform 14 to hold a grade stake for hammering into the ground. Grade stake guide 50 includes bracket 52 which connects to platform 14 using any suitable means such as welding. Bracket 52 includes a circular opening (not shown) into which sleeve 51 fits. Sleeve 51 connects to bracket 52 using any suitable means such as welding, or, alternatively, sleeve 51 removably mounts into bracket 52 and is held in place by friction.

Frame 11 includes front brace 15 which, in this preferred embodiment, is U-shaped and attaches to platform 14 using any suitable means such as welding. Frame 11 includes upper brace 16 to secure rear braces 12 and 13 to front brace 15. In this preferred embodiment, upper brace 16 is U-shaped and attaches to rear braces 12 and 13 and front brace 15 using any suitable means such as welding or nuts and bolts. Frame 11 further includes axle 17 which connects to rear braces 12 and 13 using any suitable means such as welding. Wheels 18 and 19 attach to axle 17 to permit the easy rolling of grade stake driver 10.

Frame 11 includes harness 21 and hoist 22 that support hammer 20. In this preferred embodiment, hammer 20 is an electric hammer manufactured by Makita Corporation. Although hammer 20 is electric, one of ordinary skill in the art will recognize that a pneumatic or hydraulic hammer could be substituted. Hammer 20 includes rod holder 29 attached to its hammer bit. Rod holder 29 includes brace 30 that mounts to the hammer bit using any suitable means such as welding. Rod holder 29 further includes support member 31 which consists of four prongs that frictionally engage elevation rod 100 to hold elevation rod 100 parallel to frame 11. Rod holder 29 supports elevation rod 100 to permit a user to determine the distance an unknown location resides either above or below a fixed level plane.

Harness 21 includes shuttle 80 having guides 23 and 24. Guides 23 and 24 reside around rear braces 12 and 13, respectively, to permit the vertical movement of shuttle 80. Harness 21 further includes bracket 25 which mounts over hammer 20 and connects to shuttle 80 using any suitable means such as nuts and bolts or welding. Bracket 25 secures hammer 20 to shuttle 80 thereby suspending hammer 20 within rear braces 12 and 13 and permitting vertical movement of hammer 20 relative to rear braces 12 and 13.

Hoist 22 supports hammer 20 on front brace 15 and provides means for raising and lowering hammer 20. Hoist 22 includes crank 26 which rotatably mounts through opposing openings in upper brace 16. Crank 26 includes a protrusion (not shown) at its end opposite from its handle which prevents the dislodging of crank 26 from upper brace 16. In this preferred embodiment, crank 26 does not include a latch because hammer 20 resides on either a grade stake or in grade stake guide 50 against the ground. However, one of ordinary skill in the art will recognize that a latch may be provided so that hoist 22 supports hammer 20 suspended above grade stake guide 50.

Hoist 22 further includes spool 27 that mounts around crank 26 to support strap 28 which passes around front brace 15 upper brace 16 and secures to shuttle 80. A first end of strap 28 wraps around shuttle 80 and is secured against itself to form a loop supporting shuttle 80 and thus hammer 20 using any suitable means such as an adhesive or stitching. Spool 27 includes 2 slots spaced ninety degrees apart into which a second end of strap 28 is fed. Once the second end of strap 28 is fed through those slots and a portion of it rolled onto spool 27, spool 27 holds strap 28 to facilitate the support of hammer 20 on front brace 15.

Grade stake driver 10 includes generator 32 and battery 33 which both mount onto platform 14 using any suitable means such as brackets. In this preferred embodiment, generator 32 is a gas powered 120 VAC generator utilized to provide the AC power required by hammer 20. In this preferred embodiment, battery 33 is a 7.2 VDC battery utilized to supply the DC power required by the receiver 34, switch 35, and relay 36 of grade stake driver 10.

Grade stake driver 10 includes receiver 34, switch 35, and relay 36 to permit remote triggering of hammer 20. Bracket 37 mounts to front brace 15 using any suitable means such as welding to provide the support for receiver 34, switch 35, and relay 36. Although not shown, grade stake driver 10 includes a hand-held transmitter utilized to activate receiver 34. In this preferred embodiment, the transmitter and receiver 34 are a 75 MHz AM transmitter/receiver pair manufactured by Japan Remote Control Company, Ltd.

Battery 33 connects to switch 35 via electrical line 38 to provide the DC power required to operate receiver 34 and relay 36. Generator 32 connects to relay 36 via electrical line 39 to supply AC power to hammer 20. Relay 36 connects to hammer 20 via electrical line 40 to convey the AC power delivered from generator 32. In this preferred embodiment, switch 35 is a Super Flying power switch, while relay 36 is an IDEC solid state relay.

In operation, a first member of a survey team positions grade stake driver 10 at a point where a grade stake must be set. The first team member then places a grade stake within grade stake guide 50 followed by the lowering of hammer 20 such that the hammer bit resides on the grade stake. The placing of the hammer bit directly on the grade stake places the elevation rod within rod holder 29 in a position to indicate the depth of the grade stake.

A second team member of the survey team at the known elevation views the elevation rod using a construction level. The construction level user then activates the transmitter which outputs a signal received by receiver 34. Switch 35 transforms the voltage received from battery 33 to supply receiver 34 with the appropriate supply voltage required for its operation. When receiver 34 receives a signal, it activates to output a control signal to switch 35. Switch 35 inputs that control signal and converts it into an on/off control signal utilized to control relay 36. The on/off control signal output from switch 35 actuates relay 36 thereby connecting hammer 20 with generator 32. As a result, hammer 20 activates to begin driving the grade stake into the ground. The construction level user manipulates the transmitter to facilitate the driving of the grade stake as previously described until the elevation rod resides in a position indicating that the grade stake has been set to the proper level.

Once the grade stake resides at the proper level, the first team member tilts grade stake driver 10 rearward about wheels 18 and 19. The tilting of grade stake driver 10 lifts grade stake guide 50 from the grade stake to permit the movement of grade stake driver 10 to the next location. Alternatively, if sleeve 50 is removable, the first team member removes it so that grade stake driver 10 more easily disengages from the grade stake. After removing grade stake driver 10 from the grade stake, the first team member rolls it to the next grade stake location using wheels 18 and 19.

Accordingly, grade stake driver 10 provides a means to automatically set grade stakes without the use of hand signals or a two way radio. Grade stake driver 10, therefore, prevents miscommunications that result in incorrectly set grade stakes. Although grade stake driver 10 has been described with remote activation of hammer 20, one of ordinary skill in the art will recognize that a switch between generator 32 and hammer 20 will allow the first team member to activate hammer 20. The first team member activates hammer 20 in instances when remote activation is impractical such as if the distance from the second team member is too great for remote activation or accurate viewing of the elevation rod after hammer activation.

Figure 4:
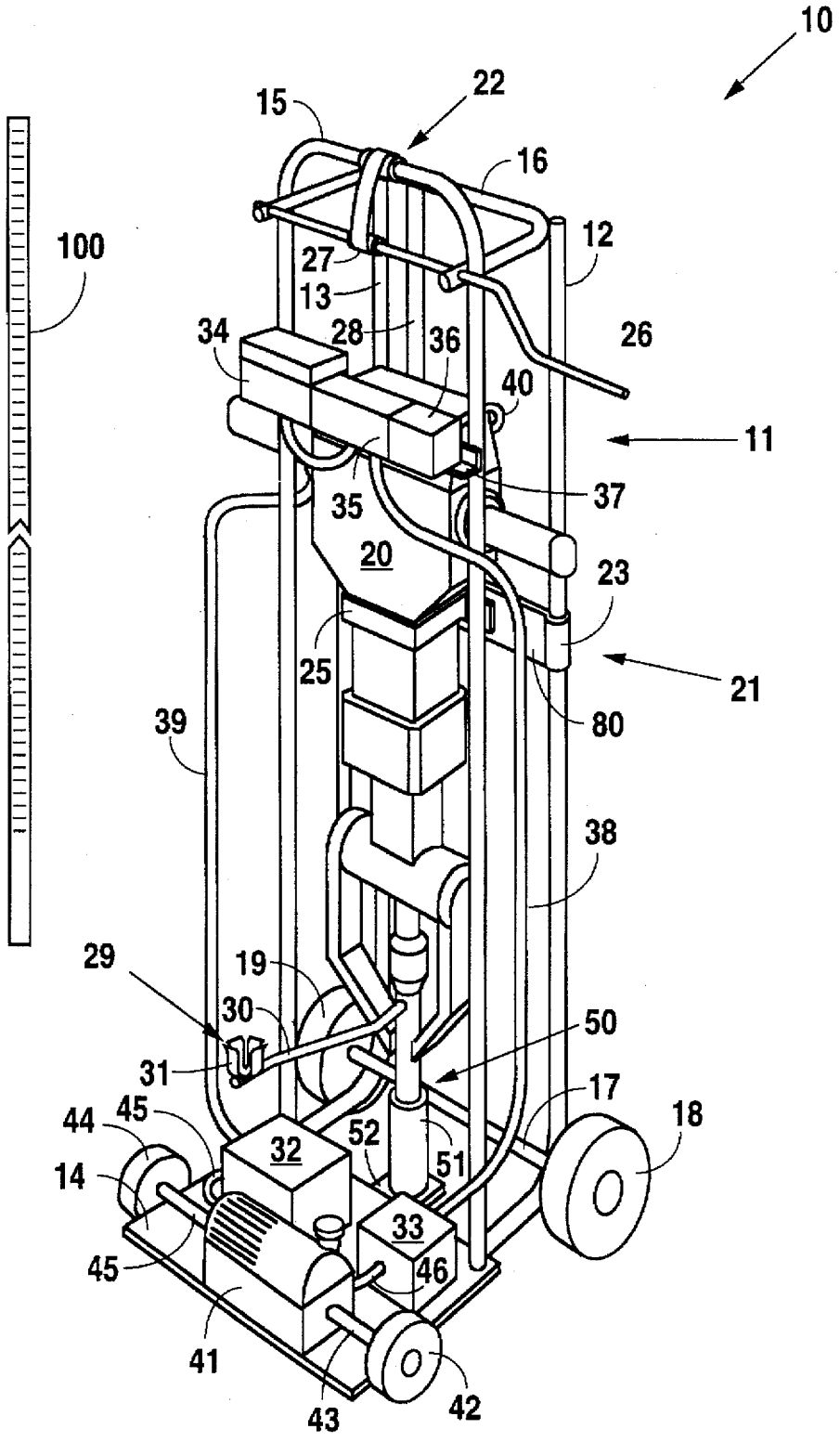
FIG. 4 is a perspective view illustrating an alternative embodiment of the apparatus for driving grade stakes.

As illustrated in FIG. 4, grade stake driver 10 may be fitted with motor 41 which is then utilized to remotely propel grade stake driver 10 from point to point. Like parts of grade stake driver 10 illustrated in FIG. 4 have been referenced with like numerals. Motor 41 may be an AC motor that receives power from generator 32 via electrical line 45. Motor 41 connects to platform 14 using any suitable means such as brackets and includes axles 43 and 45 which support wheels 42 and 44, respectively. Motor 41 includes a receiver, switch, and relay similar in design to receiver 34, switch 35, and relay 36. The switch connects to battery 33 via electrical line 46 to provide the DC power required by the receiver and relay. The construction level user would have a transmitter that activates the receiver resulting in the relay supplying AC power to motor 41 which then propels grade stake driver 10.

A feed tube filled with grade stakes could be mounted to frame 11 to automatically feed grade stakes into grade stake guide 50. Hoist 22 would be fitted with a motor and gears that permit its remote raising and lowering. The motor could be remotely controlled using the above-described receiver, switch, and relay system. Additionally, grade stake driver 10 would include a lift that tilts it to disengage grade stake guide 50 from the grade stake. Consequently, grade stake driver 10 would be fully automated requiring only a construction level user in the setting of grade stakes.

Alternatively, motor 41 and the lift may be fitted with switches activated by a team member positioned with grade stake driver 10. That would eliminate the necessity of the automatic grade stake feeder yet allow easier handling of grade stake driver 10 because it would be self-propelled.

Although the present invention has been described in terms of foregoing embodiment, such description has been for exemplary purposes and, as will be apparent to those of ordinary skill in the art, many alternatives, equivalents, and variations of varying degrees will fall within the scope of the present invention that scope, accordingly, is not to be limited in any respect by the foregoing description, rather, it is defined only by the claims that follow.

We claim:

1. An apparatus for driving a grade stake, comprising:

a hammer including a hammer bit for driving the grade stake;

a frame for supporting said hammer and the grade stake under said hammer;

means for triggering the activation of said hammer; and an elevation rod holder attached to said hammer bit, wherein the placement of an elevation rod in said elevation rod holder permits the driving of the grade stake to a desired elevation.

2. The apparatus according to claim 1 further comprising a power source for said hammer.

3. The apparatus according to claim 1 further comprising a power source for said means for triggering the activation of said hammer.

4. The apparatus according to claim 1 wherein said means for triggering the activation of said hammer, comprises:

a receiver for outputting a control signal responsive to a transmitted signal;

a switch for transforming the control signal into an on/off signal; and a relay for connecting said hammer to a power source responsive to said on/off signal.

5. The apparatus according to claim 1 wherein said means for triggering the activation of said hammer comprises a switch mounted on said frame and connected between said hammer and a power source.

6. The apparatus according to claim 1 wherein said frame comprises a front brace and a rear brace connected together with a transverse brace.

7. The apparatus according to claim 6 wherein said frame, comprises:

a harness secured to said hammer and movable mounted onto said rear brace of said frame; and a hoist mounted onto said front brace of said frame and secured to said harness.

8. The apparatus according to claim 7 wherein said hoist comprises:

a crank mounted on said frame;

a strap connected to said shuttle; and a spool about said crank for connecting said strap to said crank.

9. The apparatus according to claim 7 wherein said harness comprises a shuttle mounted on said frame and attached to said hammer with a bracket.

10. The apparatus according to claim 6 wherein said frame further comprises a platform mounted to said rear brace for supporting a power source for said hammer and a power source means for triggering the activation of said hammer.

11. The apparatus according to claim 10 wherein said frame further comprises a grade stake guide mounted to said platform.

12. The apparatus according to claim 1 wherein said frame further comprises wheels.

13. The apparatus according to claim 1 further comprising means for driving said frame.

* * * * *